United States Patent [19]

Takaoka et al.

[11] Patent Number: 4,516,332

[45] Date of Patent: May 14, 1985

[54] APPARATUS FOR CLARIFYING AND CIRCULATING HOT AIR FOR HEAT-TREATING TEXTILE FABRICS

[75] Inventors: Shozo Takaoka; Akio Hirasako, both of Wakayama, Japan

[73] Assignee: Wakayama Iron Works, Ltd., Wakayama, Japan

[21] Appl. No.: 535,654

[22] Filed: Sep. 26, 1983

[30] Foreign Application Priority Data

Jun. 2, 1983 [JP] Japan ..... 58-97009

[51] Int. Cl.[3] ..... F26B 21/06

[52] U.S. Cl. ..... 34/79; 34/158; 34/160

[58] Field of Search ..... 34/79, 80, 158, 160; 68/18 F; 110/203; 502/304, 327

[56] References Cited

U.S. PATENT DOCUMENTS

| | | | |
|---|---|---|---|
| 3,429,057 | 2/1969 | Thygeson, Sr. | 34/160 |
| 4,094,077 | 6/1978 | Schrader et al. | 34/158 |
| 4,133,636 | 1/1979 | Flynn | 34/158 |
| 4,137,648 | 2/1979 | Rhodes | 34/158 |
| 4,171,288 | 10/1979 | Keith et al. | 502/327 |
| 4,197,659 | 4/1980 | Brinkhaus et al. | 34/160 |
| 4,216,592 | 8/1980 | Koch, II | 34/160 |
| 4,274,981 | 6/1981 | Suzuki et al. | 502/304 |
| 4,299,734 | 11/1981 | Fujitani et al. | 502/304 |

*Primary Examiner*—Edward G. Favors
*Assistant Examiner*—Steven E. Warner
*Attorney, Agent, or Firm*—Paul & Paul

[57] ABSTRACT

An apparatus of clarifying and circulating hot air for heat-treating textile fabric, comprises (A) a heating chamber having a plurality of components connected to each other and partitioned into a hot air-conditioning upper chamber and a fabric-treating lower chamber in which a fabric-passing space is formed and in each compartment, a hot air nozzle means is connected to the fabric-passing space, (B) a hot air-circulation flue extending through the compartments of the hot air-conditioning upper chamber and connected to the hot air nozzle means, (C) a hot air-exhaust flue has exhaust air suction ports connected to the fabric-passing space, and (D) at least one hot air-clarifying box located in the front half portion of the hot air-conditioning upper chamber, having a hot air heater and an oxidizing catalyst layer located therein and connected to the hot air-circulation flue through a hot air-distributing duct and to the hot air-exhaust duct.

4 Claims, 8 Drawing Figures

APPARATUS FOR CLARIFYING AND CIRCULATING HOT AIR FOR HEAT-TREATING TEXTILE FABRICS

BACKGROUND OF THE INVENTION (1) Field of the Invention

The present invention relates to an apparatus for clarifying and circulating hot air for treating textile fabrics. More specifically, it relates to an apparatus that circulates hot air for heat-treating textile fabrics at a high heat efficiency while clarifying the hot air.

(2) Description of the Prior Art

In a conventional heat-setting stenter or a curing apparatus for heat-treating fabric treated with a finishing agent, hot air is usually blown to the fabric at temperature of from 150° C. to 230° C. In this temperature range, oily and fatty components in the finishing agent on the fabric and oily and fatty substances in a lubrication oil fed to the heat-treating apparatus are gasified (vaporized and/or sublimated). The resultant vaporized substances diffuse into the hot air. When the concentration of vaporized substances in the hot air exceeds a critical value, a portion of the vaporized substances condenses in some relatively low temperature portions of the apparatus, resulting in the formation of tar-like droplets. These not only contaminate the interior of the apparatus but also fall on the fabrics to stain them.

To prevent the formation of the above-mentioned tar-like droplets, a new-type of hot air-clarifying apparatus has recently been developed. In this apparatus a portion of the exhausted hot air is heated to raise its temperature. The heated exhausted hot air is brought into contact with an oxidation catalyst to oxidize the oily and fatty substances vaporized in the hot air to modify them into water vapor and carbon dioxide gas. This type of apparatus is disclosed, for example, in Japanese Unexamined Patent Publication (Kokai) No. 56-29495.

In the conventional apparatus for heat-treating fabrics, however, both the hot air-clarifying apparatus and the hot air-circulating apparatus are arranged outside a hot air-treating chamber. The construction of the heat-treating apparatus therefore becomes complicated and results in large heat loss. When the heat-treating apparatus is divided into a plurality of compartments, furthermore, the hot air-clarifying apparatus located in the outer side must be so constructed that the hot air is uniformly withdrawn from each of the compartments and uniformly distributed again into each of the compartments after clarification. This, however, increases the cost of the apparatus and the operation.

SUMMARY OF THE INVENTION

An object of the present invention is to provide an apparatus for clarifying and circulating hot air for heat-treating textile fabrics at an increased clarifying efficiency and at a high heat economy.

Another object of the present invention is to provide an apparatus for clarifying and circulating hot air for heat-treating textile fabrics at a decreased heat loss and with a compact construction.

The above-mentioned objects can be attained by the apparatus of the present invention which comprises:

(A) a heating chamber divided into a plurality of interconnected compartments, said chamber being provided with a space for allowing fabrics to pass therethrough, extending through these compartments and a nozzle means for blowing hot air toward the fabrics, and being enclosed by heat-insulating walls;

(B) a hot air circulation flue which has a hot air circulating inlet port communicating with the fabric-passing space of the heating chamber (A), a hot air circulating outlet port communicating with the hot air nozzle means, and a hot air heater and circulation fan both arranged within the hot air circulation flue;

(C) a hot air exhaust duct which has exhaust air suction inlet ports communicating with the fabric-passing space and an exhaust fan located within the hot air exhaust duct; and (D) at least one hot air clarifying box with a hot air inlet port communicating with the hot air exhaust duct (C), a hot air outlet port communicating with the hot air circulation flue (B), and a hot air heater and an oxidizing catalyst layer located within the clarifying box thereof; and which apparatus is characterized in that:

(a) the heating chamber (A) is partitioned into a fabric treating lower chamber that contains the fabric-passing space and the hot air nozzle means and a hot air-conditioning upper chamber located above the fabric treating lower chamber;

(b) the hot air-circulation flue (B) extends through the compartments of the hot air conditioning upper chamber;

(c) the exhaust air suction ports of the hot air exhaust duct (C) are opened to the compartments of the fabric-treating lower chamber;

(d) at least one hot air clarifying box is disposed in the front half portion of the hot air conditioning upper chamber; and (e) a hot air outlet port of the hot air clarifying box is communicated with the hot air circulation flue (B) via hot air distributing duct provided in the hot air-conditioning upper chamber and hot air distributing ports provided in the hot air distributing duct.

DESCRIPTION OF THE PREFERRED EMBODIMENTS

The apparatus of the present invention will be described below with reference to FIGS. 1 to 8.

Figure 1:
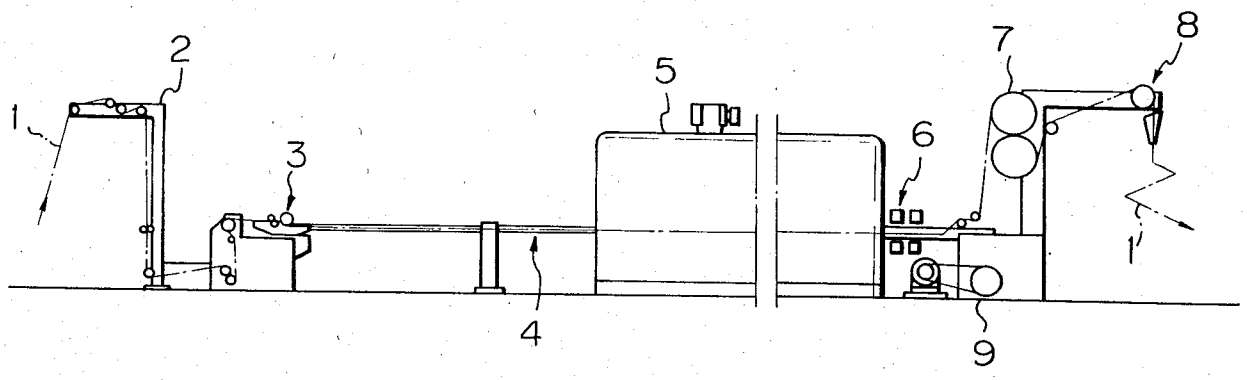
FIG. 1 is a diagram of a stenter apparatus as an example of the fabric-treating apparatus utilizing the apparatus of the present invention for clarifying and circulating hot air.

FIG. 1 illustrates a heat setting stenter as an example of the apparatus for heat-treating fabrics utilizing the apparatus of the present invention. In the stenter of FIG. 1, a fabric 1 is introduced into an inlet port of the stenter via a fabric-feeding device 2. The side edges of the fabric are held by clips of a clipping device 3. The fabric is introduced into a heat-treating chamber 5 through clip rails 4, and heat-treated therein at a desired temperature. The fabric 1 which has passed through the heat-treating chamber 5 is cooled by cooling air-blowing device 6 and water-cooling rolls 7, is released from the clips, and is delivered from the apparatus through fabric-delivering device 8. The stenter is driven by a motor 9.

The apparatus of the present invention will be explained below by referring to the stenter indicated in FIG. 1.

Figure 4:
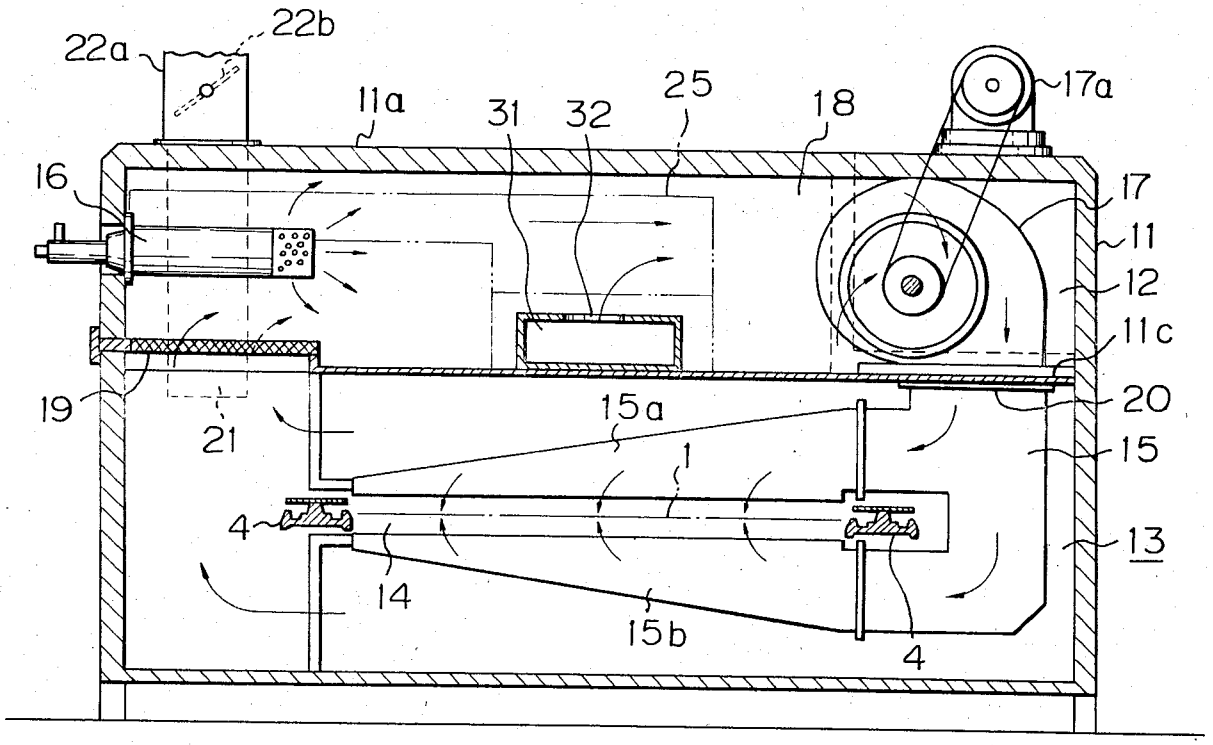
FIG. 4 is a lateral cross-section of a portion having a hot air heater, of an embodiment of the apparatus of the present invention.
Figure 5:
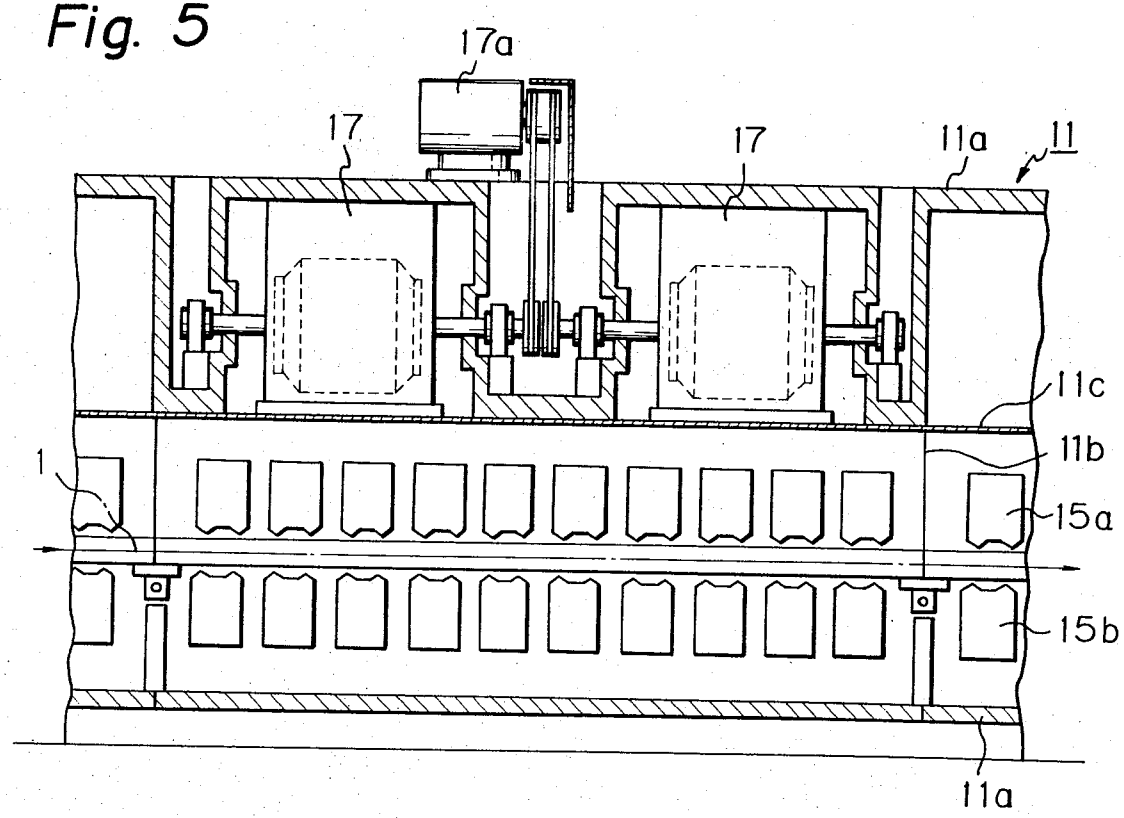
FIG. 5 is a longitudinal cross-section of a portion having a hot air circulation fan, of the apparatus indicated in FIG. 4.

In FIGS. 2 to 8, the fabric 1 passes through a stenter heating chamber 11 which extends substantially horizontally. The heating chamber 11 is divided by separator walls 11*b* into a plurality of compartments, for example, into eight compartments connected to each other which are surrounded by heat-insulating walls (ceilings) 11*a*. As shown in FIGS. 4 and 5, the heating chamber 11 is partitioned by a partition 11*c* into a hot air-conditioning upper chamber 12 and a fabric treating lower chamber 13. The fabric treating lower chamber 13 includes a space 14 for passing the fabric therethrough and a hot air nozzle means 15 (which may have upper and lower nozzles 15*a*, 15*b* directed to the upper and lower sides of the fabric 1, as shown in FIGS. 4 and 5) to blow hot air toward the fabric.

Within each compartment of the hot air-conditioning upper chamber 12, a hot air circulation flue 18 is formed and a not air heater (gas burner or radiator) 16 and a circulation fan 17, are arranged, as shown in FIGS. 4, 5, 6, 7, and 8. The hot air circulation flue 18 is communicated with the fabric-passing space 14 in the fabric treating lower chamber 13 through a hot air circulating inlet port 19 formed between the upper and lower chambers. A filter is disposed in the inlet port 19 to remove dust from the hot air. An outlet port 20 of the circulation fan 17 (i.e., an outlet port of the hot air circulation flue 18) is connected to an inlet port of the hot air nozzle means 15. The circulation fan 17 is driven by a motor 17*a*.

Figure 6:
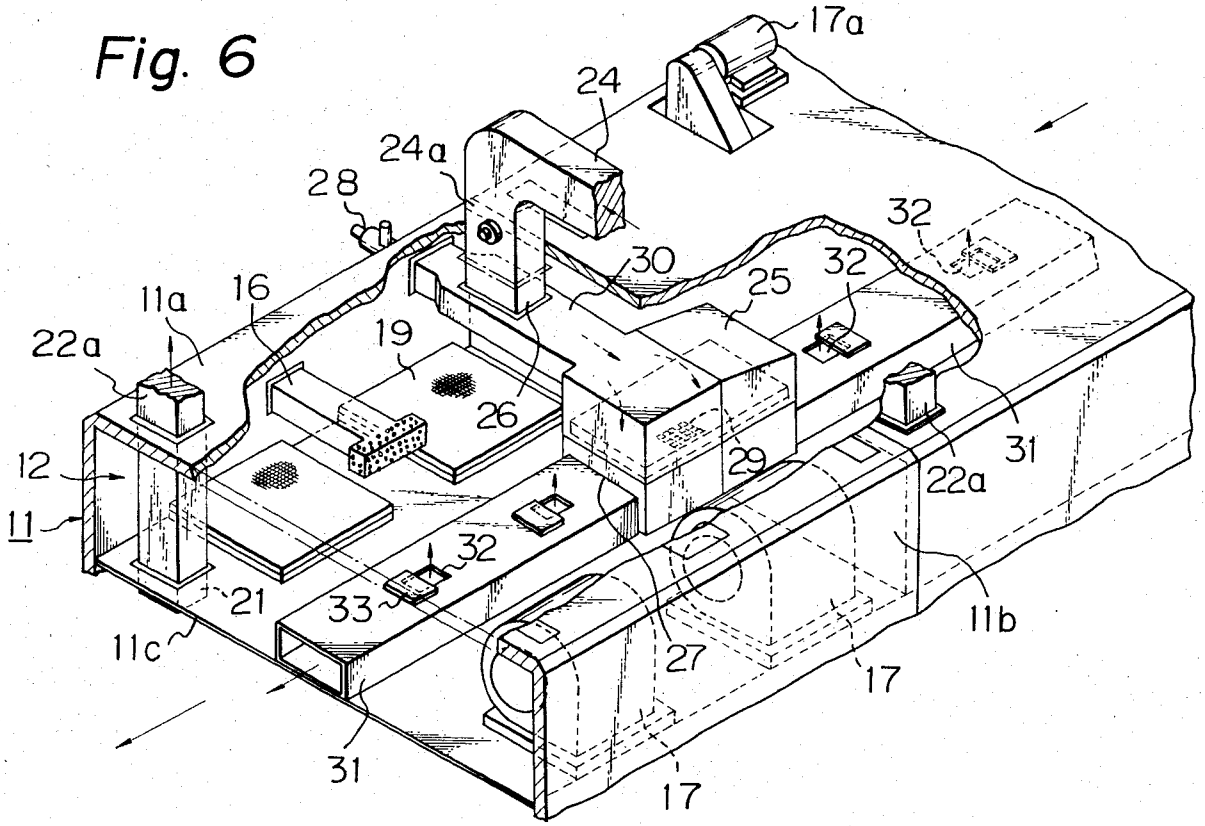
FIG. 6 is a perspective view of a portion of the upper half portion of the apparatus shown in FIGS. 4 and 5.
Figure 7:
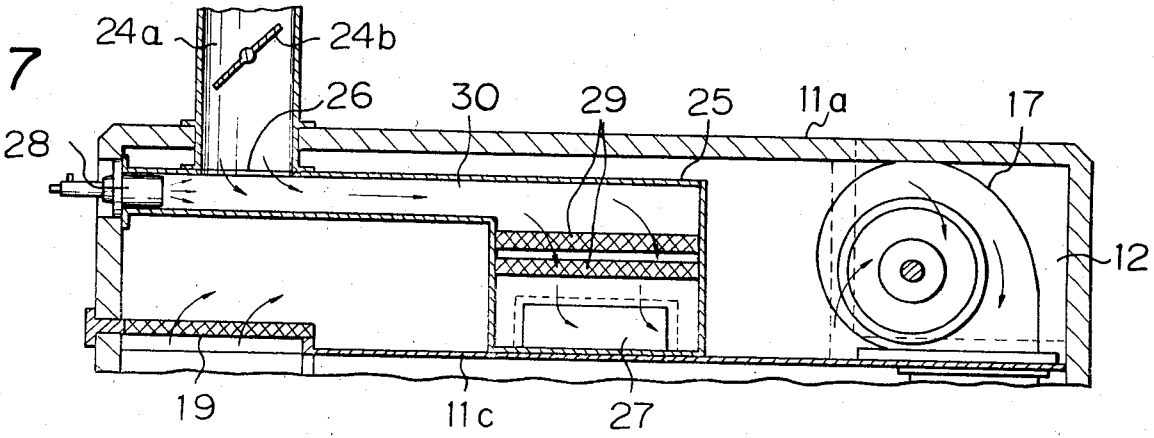
FIG. 7 is a lateral cross-section of a portion having a hot air-clarifying box, of the upper half portion of the apparatus shown in FIGS. 4 to 6.
Figure 8:
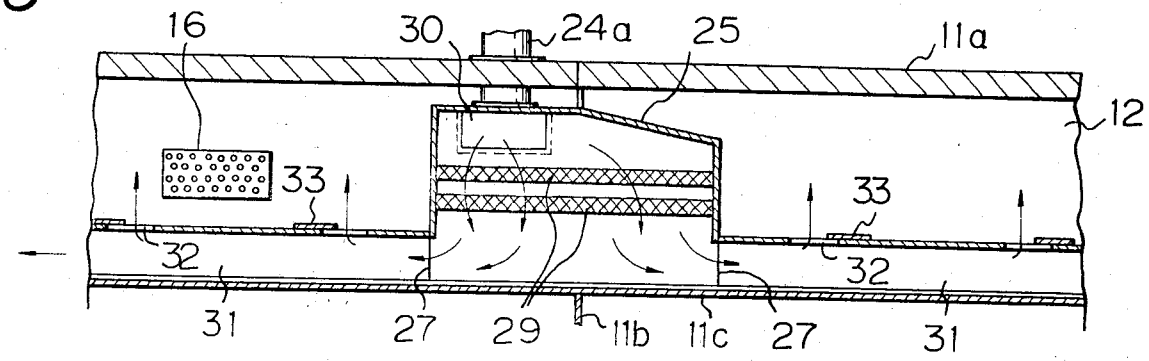
FIG. 8 is a longitudinal cross-section of a portion having a hot air distributing duct, of the upper half portion of the apparatus shown in FIGS. 4 to 7.

In each compartment of the fabric treating lower chamber 13, the fabric-passing space 14 is connected to an exhaust air suction port 21 as shown in FIGS. 4 and 6. The suction ports 21 are connected to a hot air exhaust duct 22 via branch ducts 22*a*. An exhaust fan 23 is provided in the hot air exhaust duct 22. The branch ducts 22*a* may have dampers 22*b* for controlling the exhausting rate of hot air.

The hot air exhaust duct 22 is connected to a hot air feeding duct 24, the downstream portion of which may have two or more hot air feeding branch ducts 24*a*, as required. The hot air exhaust duct 22 may be provided with a duct 22*c* for discharging a portion of the exhausted hot air to the outside of the apparatus, and with a damper 22*d* for controlling the discharging rate of the hot air.

Figure 2:
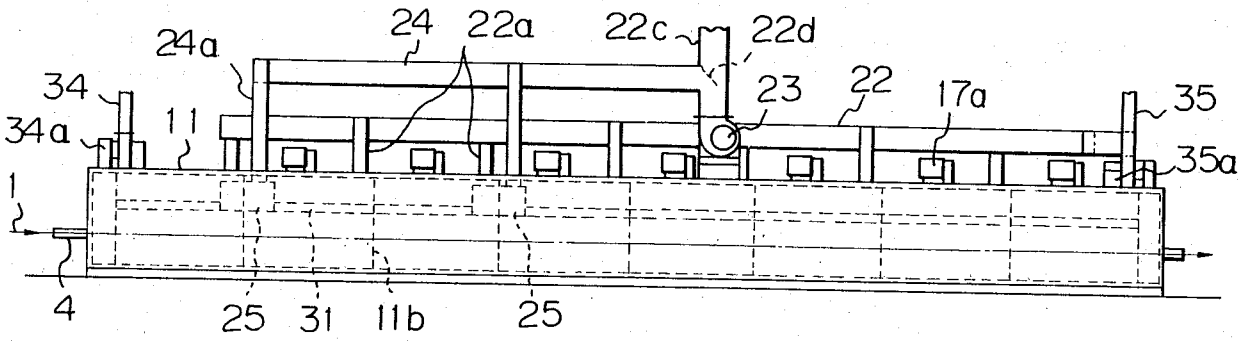
FIG. 2 is explanatory side view of an embodiment of the apparatus of the present invention.
Figure 3:
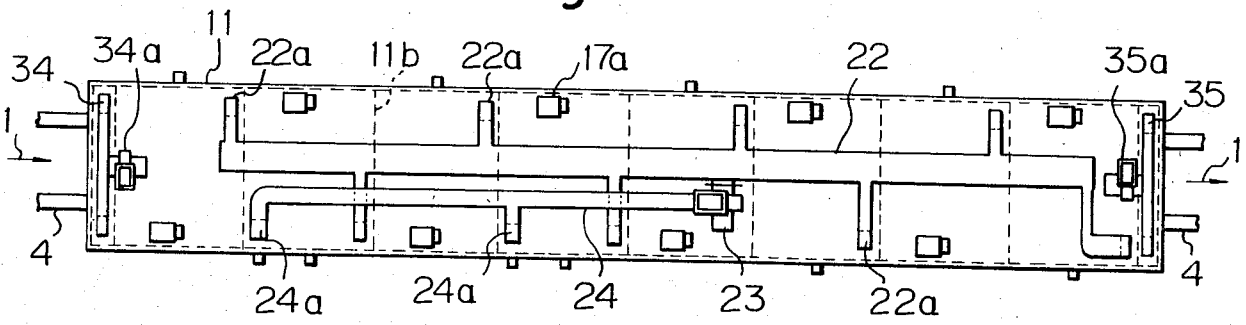
FIG. 3 is an explanatory plan view of the apparatus indicated in FIG. 2.

At least one hot air-clarifying box 25 is disposed in the front half portion of the hot air conditioning upper chamber 12 as viewed along the direction of the movement of the fabric. For instance, when the number of compartments is six or less, only one hot air-clarifying box is disposed, for example, between the first compartment and the second compartment. When the number of compartments is seven or more, two hot air-clarifying boxes are disposed for example, between the first compartment and the second compartment between the third compartment and the fourth compartment as shown in FIG. 2.

Each hot air-clarifying box 25 has a hot air inlet port 26, a hot air outlet port 27, a hot air heater (for example, a gas burner) 28 and an oxidizing catalyst layer 29. A hot air heating duct 30 may be provided between the heater 28 and the oxidizing catalyst layer 29.

The hot air inlet port 26 of the hot air-clarifying box 25 is communicated with an outlet portion of the hot air feeding duct 24, for example, communicated with the feeding branch duct 24*a*. To control the feeding rate of hot air, the branch duct 24*a* may be provided with a damper 24*b*.

The hot air outlet port 27 of the hot air-clarifying box 25 is communicated with a hot air-distributing duct 31 which extends through the compartment of the hot air-conditioning upper chamber 12. One or more hot air distributing ports 32 are formed in the hot air distributing duct 31 in each compartment, whereby, the hot air-clarifying box 25 is communicated with the hot air circulation flue 18 in each compartment of the hot air-conditioning upper chamber 2 through the distributing duct 31 and distributing ports 32. The distributing ports 32 may be provided with a door 33 for controlling the flow rate of hot air.

Generally, exhaust ducts 34, 35 are independently provided at the frontmost portion of the frontmost compartment and at the same rearmost portion of the rearmost compartment of the fabric treating chamber, each being equipped with exhaust fans 34*a*, 35*b*.

When a desired heat-treatment is applied to a fabric by using the apparatus of the present invention, the fabric 1 moves along its moving path, in each compartment of the heating chamber 11, hot air heated at desired temperatures (for example, 170° C. to 230° C.) is blown to the fabric through nozzles 15*a*, 15*b* by driving the circulation fan 17. A portion of the hot air blown to the fabric is withdrawn from the fabric-passing space 14 into the hot air circulation flue 18 via the hot air circulating inlet port 19. The withdrawn hot air is brought into contact with the heater 16 to heat it to a desired temperature. The heated hot air is circulated again into the hot air nozzle means 15 by the circulation fan 17.

In this case, the exhaust fan 23 is actuated to withdraw a portion of the hot air in the fabric treating chamber 11 through the hot air suction port 21 provided in each compartment of the fabric treating chamber 11. The thus withdrawn hot air is fed into the hot air-clarifying box 25 disposed in the front half portion of the hot air-conditioning upper chamber via the branch duct 22*a* of the hot air exhaust duct 22, the hot air exhaust duct 22, the hot air feeding duct 24, the branch duct 24*a*, and the hot air inlet port 26.

In this case, the temperature of the hot air to be fed into the clarifying box 25 is from 40° C. to 70° C. lower than that in the fabric treating lower chamber, that is, usually from 140° C. to 170° C. The hot air fed into the clarifying box 25 is heated through the hot air heater (such as a gas burner) 28, so as to be elevate it to temperature (usually, 250° C. to 350° C.) at which the oily and fatty compounds can be oxidized. The heated hot air is brought into contact with the oxidizing catalyst layer 29 through a heating duct 30. Then, organic compounds (oils and fats) in the hot air are oxidized or decomposed and are converted mainly into water (water vapor), carbon dioxide gas, and the like. The clarified hot air is fed into the hot air circulation flue 18 of each compartment via the hot air distributing duct 31 and hot air distributing port 32 and is incorporated into the hot air circulating through the hot air circulation flue 18.

There is no particular limitation on the type of hot air heater employed for the clarifying box, as long as it is capable of heating the hot air to a desired temperature. Usually, however, the heat consists of a gas burner. Further, there is no particular limitation with regard to the oxidizing catalyst, as long as it is capable of oxidizing or decomposing the organic (oily and fatty) compounds into water vapor and carbon dioxide gas. Usually, the catalyst comprises a platinum catalyst, manganese dioxide powder bonded by an adhesive or iron-manganese dioxide powder bonded together by an adhesive.

The apparatus clarifyng and circulating hot air for heat-treating fabrics according to the present invention exhibits the effects as described below.

(1) A major portion of the exhausted hot air is clarified and circulated, while only a minor portion of the hot air is discharged, i.e., the amount of the hot air discharged into the atmosphere is small. Therefore, the heating device is advantageous in heat economy and causes little air pollution.

(2) The hot air can be clarified very effectively (clarification factor of 60% to 90%), and the concentration of volatile substances in the hot air to be brought into contact with the fabric can be maintained small.

(3) The hot air circulation flue and the hot air-clarifying box, are contained in a heat-insulated hot air conditioning upper chamber. Therefore, heat loss is small, and the apparatus can be compactly constructed.

(4) Since the hot air circulated and clarified at a high heat efficiency as described hereinbefore, the temperature of the hot air to be blown to the fabric can be maintained at a high level. Accordingly, the length of the fabric-treating chamber can be shortened and or the number of the compartments can be reduced.

(5) Since the hot air withdrawn from the rear half portion of the fabric-treating chamber, which hot air has a small content of water, is fed into the front half portion of the fabric-treating chamber for clarification and mixture into the circulating hot air, the effect of heat-treatment in the front half portion can be enhanced.

We claim:

1. An apparatus for clarifying and circulating hot air for heat-treating textile fabrics, which comprises:

(A) a heating chamber which is divided into a plurality of compartments connected to each other which has space for allowing fabrics to pass therethrough, extending through these compartments, and which is provided with nozzle means for blowing hot air to the fabrics, and which is defined by heat-insulating walls;

(B) a hot air-circulation flue which has a hot air circulating inlet port communicated with the fabric-passing space of said heating chamber (A), a hot air circulating outlet port communicated with said hot air nozzle means, and a hot air heater and a circulation fan both arranged within said hot air-circulation flue;

(C) a hot air-exhaust duct which has exhaust air suction inlet ports communicated with said fabric-passing space, and an exhaust fan located within the hot air-exhaust duct; and (D) at least one hot air-clarifying box which has a hot air inlet port communicated with said hot air exhaust duct (C), a hot air outlet port communicated with said hot air circulation flue (B), and hot air heater and an oxidizing catalyst layer located within the clarifying box in which apparatus:

(a) said heating chamber (A) is partitioned into a fabric treating lower chamber which contains said fabric-passing space and said hot air nozzle means, and a hot air-conditioning upper chamber located above said fabric treating lower chamber;

(b) said hot air-circulation air flue (B) extends through the compartments of said hot air-conditioning upper chamber;

(c) said exhaust air suction ports of said hot air-exhaust duct (C) are opened to the compartments of said fabric treating lower chamber;

(d) at least one hot air clarifying box is disposed in the front half portion of said hot air-conditioning upper chamber; and (e) a hot air outlet port of said hot air-clarifying box is communicated with the hot air-circulation flue (B) via a hot air distributing duct formed in said hot air-conditioning upper chamber and hot air distributing ports provided in the hot air distributing duct.

2. The apparatus as claimed in claim 1, wherein said hot air heater in said hot air-circulation flue is a gas burner.

3. The apparatus as claimed in claim 1, wherein said hot air heater in said hot air-clarifying box is a gas burner.

4. The apparatus as claimed in claim 1, wherein said oxidizing catalyst layer is composed of a platinum catalyst, manganese dioxide powder bonded together by an adhesive, or iron-manganese dioxide powder bonded together by an adhesive.

* * * * *

UNITED STATES PATENT OFFICE

CERTIFICATE OF CORRECTION

Patent No. 4,516,332 Dated May 14, 1985

Inventor(s) Shozo Takaoka et al

It is certified that error appears in the above-identified patent and that said Letters Patent are hereby corrected as shown below:

Column 3, line 35:

"not" should read --hot--

Signed and Sealed this

First Day of October 1985

[SEAL]

*Attest:*

DONALD J. QUIGG

*Attesting Officer*

*Commissioner of Patents and Trademarks—Designate*